US005452704A

United States Patent [19]

Winebarger

[11] Patent Number: 5,452,704

[45] Date of Patent: Sep. 26, 1995

[54] DEVICE FOR DAMPENING BOWSTRING VIBRATION

[76] Inventor: David W. Winebarger, P. O. Box 117, Evington, Va. 24550

[21] Appl. No.: 251,307

[22] Filed: May 31, 1994

[51] Int. Cl.[6] ..... F41B 5/00

[52] U.S. Cl. ..... 124/92; 124/88

[58] Field of Search ..... 124/92, 90, 91, 124/88, 89, 23.1, 25.6

[56] References Cited

U.S. PATENT DOCUMENTS

| | | | |
|---|---|---|---|
| 3,584,615 | 6/1971 | Stinson . | |
| 3,746,214 | 9/1973 | Christen . | |
| 4,080,951 | 3/1978 | Bateman, III . | |
| 4,160,437 | 7/1979 | Fletcher . | |
| 4,542,732 | 9/1985 | Troncoso | 124/90 X |
| 4,628,892 | 12/1986 | Windedahl et al. | 124/92 X |
| 4,917,070 | 4/1990 | Townsend | 124/88 X |
| 5,016,604 | 5/1991 | Tilby . | |
| 5,161,514 | 11/1992 | Cary | 124/88 X |

*Primary Examiner*—Randolph A. Reese
*Assistant Examiner*—Harry C. Kim
*Attorney, Agent, or Firm*—Norman B. Rainer

[57] ABSTRACT

A device adapted for attachment to a compound archery bow to dampen bowstring vibration includes paired straight arms that are urged together by spring action. The facing surfaces of the arms carry cushioning material adapted to embrace the bowstring in the undrawn state of the bow. A cam-activated trigger lever prys the arms apart as the bowstring is drawn. When the bowstring is released, the trigger allows the arms to close again upon the bowstring.

8 Claims, 2 Drawing Sheets

DEVICE FOR DAMPENING BOWSTRING VIBRATION

BACKGROUND OF THE INVENTION

1. Field of the Invention

This invention relates generally to archery bows and in particular to bowstring silencer means which engage the bow string and thereby reduce the sound of the bowstring.

2. Description of the Prior Art

Bowstring silencer devices have been disclosed which eliminate or minimize the characteristic "twang" generated by releasing the bowstring to propel an arrow from the bow. This noise has long plagued archers and bow hunters, since it almost invariably produces a reflex action in a hunted animal, causing it to flinch and thereby avoid the arrow directed toward it.

Most modern bows are "compound" bows comprising a handle, paired flexing limbs emergent from the handle, pulley wheels mounted upon the distal extremities of the limbs, a cable extending in a doubled crossing path between the pulley wheels, and a bowstring disposed in a straight line between the ends of the cable and in alignment with the rear extremities of the pulley wheels. A cable guide rod extends rearwardly from the handle to control the position of the cable laterally with respect to the bow.

Prior disclosures of bowstring silencers have involved devices which generally attach to the bowstring, as in U.S. Pat. Nos. 3,584,615; 3,756,214; 4,080,951; and 5,016,604. Such devices have a tendency to detract somewhat from the total energy deliverable by the bowstring to the arrow. Some of such devices cause damage to the bowstring, and occasionally fall off the bowstring during use. Some older silencer devices are not amenable to use on compound bows, or require customized installation or cannot accommodate different bows.

It is accordingly an object of the present invention to provide a device for use in a compound bow to minimize the noise generated upon release of the bowstring from the drawn position.

It is a further object of this invention to provide a device as in the foregoing object which can easily be installed upon a compound bow.

It is another object of the present invention to provide a device of the aforesaid nature which is compatible with left and right hand bows.

It is a still further object of this invention to provide a device of the aforesaid nature which permits adjustability to accommodate the specific characteristics of a particular bow.

It is yet another object of the present invention to provide a device of the aforesaid nature of simple, light weight and rugged construction amenable to low cost manufacture.

These and other beneficial objects and advantages will be apparent from the following description.

SUMMARY OF THE INVENTION

The above and other beneficial objects and advantages are accomplished in accordance with the present invention by a bowstring dampener device adapted to be mounted upon a cable guide post of a compound bow, said device comprising:

a) mounting means having a first extremity and a second extremity adapted to attach to said guide post, b) a bifurcated spring member comprised of an arcuate portion that attaches to the first extremity of said mounting means and paired first and second straight arm portions emergent from said arcuate portion and extending in facing relationship to distal extremities, said spring member having a plane of symmetry located between said arm portions, c) cushioning means disposed upon the facing surfaces of said arm portions, d) elongated trigger means having a proximal extremity pivotably attached to said spring member in association with said first arm portion, a cam portion adjacent said proximal extremity, and a distal extremity co-directional with the second extremity of said mounting means, e) retaining means disposed in association with said second arm portion and adapted to interact with said trigger means, f) a control sleeve slidably positionable upon said guide post, and g) tether means extending between the distal extremity of said trigger means and said anchoring member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
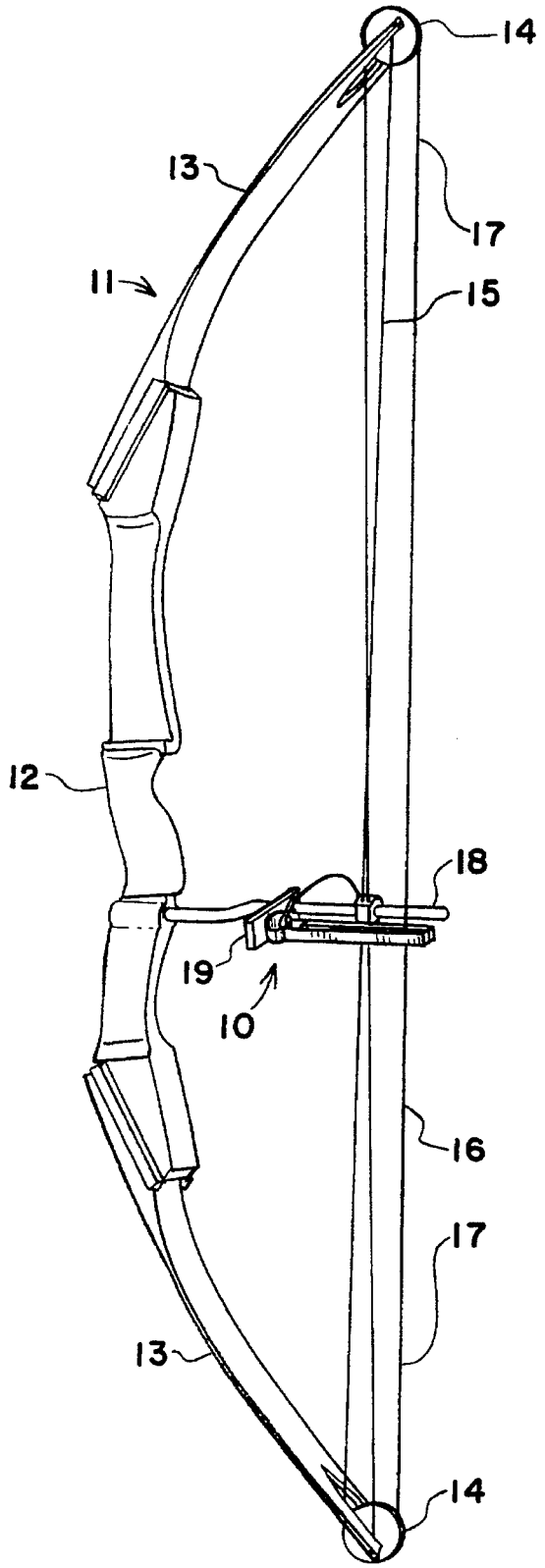
FIG. 1 is a rear perspective view of a compound bow of conventional design equipped with the bowstring dampening device of this invention.
Figure 2:
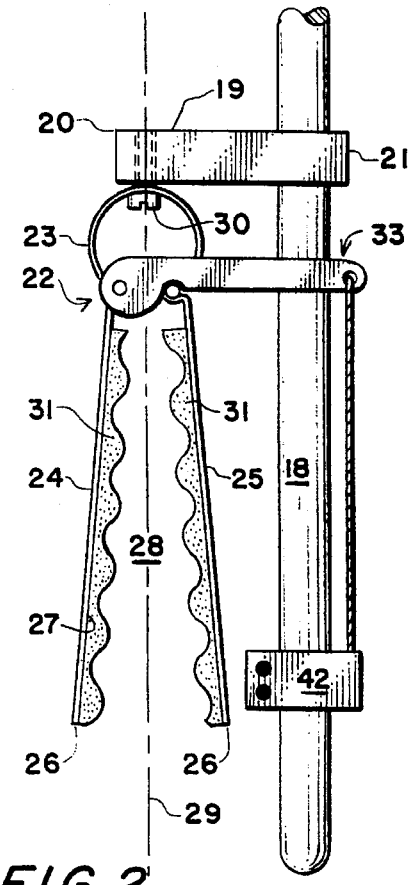
FIG. 2 is a top view of an embodiment of the device of this invention shown in a state of its function corresponding to the drawn position of the bowstring.
Figure 3:
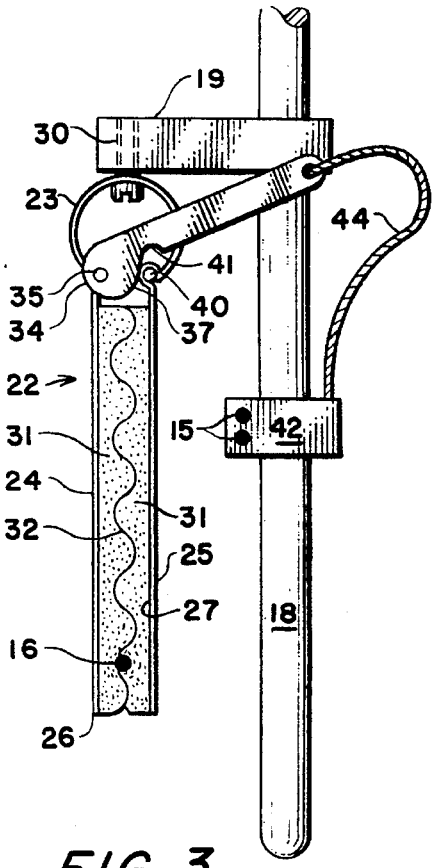
FIG. 3 is a top view of the embodiment of FIG. 2 shown in a state of its function corresponding to the released position of the bowstring.
Figure 4:
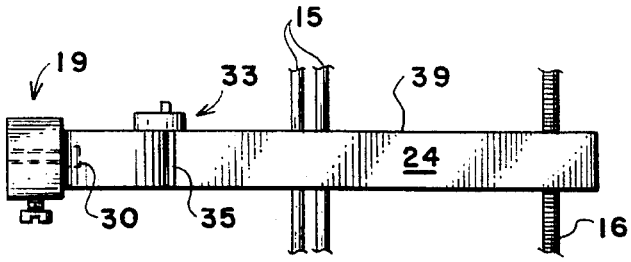
FIG. 4 is a side view of the embodiment of FIG. 3.
Figure 5:
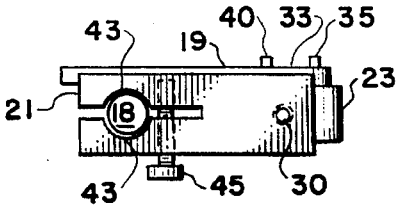
FIG. 5 is an end view of the embodiment of FIG. 2.

Referring now to FIGS. 1–5, an embodiment of the bowstring silencer device 10 of this invention is shown in functional engagement with a compound bow 11 of conventional design.

Bow 11 is comprised of centered handle 12, paired flexing limbs 13 emergent from the handle, pulley wheels 14 mounted upon the free extremities of the limbs, a cable 15 extending in a doubled, crossing path between said pulley wheels, and a bowstring 16 disposed between the ends 17 of the cable and in alignment with the rear extremities of said pulley wheels. A cable guide post 18 extends rearwardly from the handle for the purpose of constraining the position of the cable to a plane laterally spaced from the plane that contains the centerline of the bow, and bowstring. Such constraint of the cable is achieved by control sleeve 42 which engages the cable and slides freely in reciprocal motion upon guide post 18.

The silencer device 10 of this invention includes mounting means 19 of elongated shape having a first extremity 20 and a second extremity 21 adapted to attach to guide post 18.

In the exemplified embodiment, extremity 21 is bifurcated and has facing semi-circular recesses 43 adapted to embrace guide post 18. A threaded tightening bolt 45 enables said recesses to be urged together into secure gripping engagement of guide post 18. The length of said mounting means, measured between the first and second extremities, may range between about 1 and 3 inches.

The bifurcated spring member 22 is attached to the first extremity 20 mounting means 19. Said spring member is comprised of arcuate portion 23 and paired first and second straight arm portions 24 and 25, respectively emergent from said arcuate portion and terminating in distal extremities 26. The arm portions have facing surfaces 27 disposed in facing relationship and defining an interior region 28. The spring member is constructed so as to have a plane of symmetry, designated by numeral 29 of FIG. 2, located between said arm portions. An attachment bolt 30 penetrates said arcuate portion upon plane 29, and secures the spring member to the first extremity of mounting means 19. Spring member 22 is biased such that arm portions 24 and 25 are urged together with a force in the range of 10–15 pounds.

Cushioning material 31 is disposed upon both facing surfaces 27. Said cushioning material is preferably comprised of a resilient rubber or polymeric material, and is preferably shaped so as to have an interlocking contour such as the wave-like configuration 32 exemplified in FIGS. 2 and 3.

Elongated trigger bar 33, having proximal extremity 34 is attached by pivot means 35 to spring member 22 at a site where first arm portion 24 emerges from arcuate portion 23. Bar 33 extends to distal extremity 36 oriented in the same direction as second extremity 21 of mounting means 19. A cam portion 37 is disposed upon the rearward edge 38 of bar 33 adjacent proximal extremity 34. Trigger bar 33 is adapted to move in an arcuate path in a plane above the upper edge extremity 39 of the spring member.

Retaining means in the form of rod 40 extends upwardly from the intersection of arcuate portion 23 with said second arm portion, and is adapted to engage a recess 41 disposed in rearward edge 38 of bar 33 adjacent cam portion 37.

A compliant but non-extensible tether cable 44 extends between the distal extremity 36 of bar 33 and control sleeve 42.

In operation, the cushioning material 31 tightly embraces bowstring 16 until it is drawn. As the bowstring is pulled, sleeve 42 moves rearwardly with the bowstring. Such action pulls distal extremity 36 of bar 33 rearwardly, causing cam portion 37 to force apart said arm portions, with attendant release of the embracement of the bowstring. Upon release of the drawn bowstring, cable 15 strikes trigger bar 33 by virtue of the forward momentum of the cables, which travel about one inch forwardly of the rest position on the undrawn bow. The struck trigger bar moves forwardly,releasing retaining rod 40 and thereby permitting said arms to again converge upon and embrace the bowstring. When embraced in this manner, vibrations of the bowstring and attendant noise immediately cease.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A bowstring dampener device adapted to be mounted upon a cable guide post of a compound bow, said guide post slideably supporting a control sleeve that engages a cable attached to a bowstring, said device comprising:

a) mounting means having a first extremity and a second extremity adapted to attach to said guide post, b) a bifurcated spring member comprised of an arcuate portion that attaches to the first extremity of said mounting means and paired first and second straight arm portions emergent from said arcuate portion and extending in facing relationship to distal extremities, said spring member having a plane of symmetry located between said arm portions, c) cushioning means disposed upon the facing surfaces of said arm portions, d) elongated trigger means having a proximal extremity pivotably attached to said spring member in association with said first arm portion, a cam portion adjacent said proximal extremity, and a distal extremity co-directional with the second extremity of said mounting means, e) retaining means disposed in association with said second arm portion and adapted to interact with said trigger means, and f) tether means extending between the distal extremity of said trigger means and said control sleeve.

2. The device of claim 1 configured such that, when mounted upon said cable guide post, the bowstring resides within said plane of symmetry and disposed between said arm portions in the undrawn state of the bow.

3. The device of claim 1 wherein said tether means is a compliant non-extensible cable.

4. The device of claim 3 wherein the length of said tether means is shorter than the length of said guide post.

5. The device of claim 3 wherein the length of said tether means is shorter than the length of the straight arm portions of said spring member.

6. The device of claim 4 wherein the second extremity of said mounting means is bifurcated, having facing semi-circular recesses adapted to embrace said guide post.

7. The device of claim 3 wherein the cushioning means disposed upon the facing surfaces of said arm portions reside in contacting relationship and embrace the bowstring in the undrawn state of the bow.

8. The device of claim 3 wherein the length of said tether means is such that rearward sliding movement of said control sleeve pulls the distal extremity of said trigger means rearwardly, causing said arms to become locked in a spaced apart condition corresponding to the drawn state of the bow, and forward sliding movement of said control sleeve pushes said distal extremity forwardly, causing said arms to move together.

* * * * *